US008180558B1

(12) United States Patent
Marko

(10) Patent No.: US 8,180,558 B1
(45) Date of Patent: May 15, 2012

(54) SYSTEM AND METHOD FOR IMPROVED TRAFFIC FLOW REPORTING USING SATELLITE DIGITAL AUDIO RADIO SERVICE (SDARS) AND VEHICLE COMMUNICATIONS, NAVIGATION AND TRACKING SYSTEM

(75) Inventor: Paul D. Marko, Pembroke Pines, FL (US)

(73) Assignee: XM Satellite Radio Inc., Washington, DC (US)

( * ) Notice: Subject to any disclaimer, the term of this patent is extended or adjusted under 35 U.S.C. 154(b) by 1064 days.

(21) Appl. No.: 12/098,085

(22) Filed: Apr. 4, 2008

Related U.S. Application Data

(60) Provisional application No. 60/907,494, filed on Apr. 4, 2007.

(51) Int. Cl.
*G06G 7/70* (2006.01)
*G08G 1/00* (2006.01)

(52) U.S. Cl. ..... 701/119; 340/936

(58) Field of Classification Search ..... 701/119, 701/117; 370/259, 270; 455/3.01, 3.02; 340/901, 905, 936, 466, 670
See application file for complete search history.

(56) References Cited

U.S. PATENT DOCUMENTS

| | | | | |
|---|---|---|---|---|
| 6,615,130 | B2 | 9/2003 | Myr | |
| 6,911,918 | B2 | 6/2005 | Chen | |
| 7,400,674 | B2 * | 7/2008 | Gu | 375/225 |
| 7,440,842 | B1 * | 10/2008 | Vorona | 701/117 |
| 7,589,643 | B2 * | 9/2009 | Dagci et al. | 340/905 |
| 2001/0028314 | A1 | 10/2001 | Hessing et al. | |
| 2002/0021674 | A1 | 2/2002 | Thorne et al. | |
| 2002/0194170 | A1 | 12/2002 | Israni et al. | |
| 2005/0143047 | A1 * | 6/2005 | Kwon et al. | 455/345 |
| 2005/0216147 | A1 | 9/2005 | Ferman | |
| 2007/0038363 | A1 * | 2/2007 | McGrath | 701/117 |
| 2007/0115113 | A1 * | 5/2007 | Wang | 340/539.13 |
| 2007/0130248 | A1 | 6/2007 | Thacher | |
| 2007/0138347 | A1 | 6/2007 | Ehlers | |
| 2007/0294023 | A1 | 12/2007 | Arcot et al. | |
| 2008/0065325 | A1 | 3/2008 | Geelen et al. | |
| 2010/0274477 | A1 * | 10/2010 | Okamoto | 701/201 |

OTHER PUBLICATIONS

David McClure, "Best Practice Recommendations for Implementing RDS TMC Services", European Telematics Whitepaper, Apr. 2004, Report Ref.: SBD/TEL 330, pp. 1-10.

(Continued)

*Primary Examiner* — Mark Beauchaine
(74) *Attorney, Agent, or Firm* — Roylance, Abrams, Berdo & Goodman, LLP

(57) ABSTRACT

A system and method for traffic flow reporting are provided. An satellite digital audio radio service (SDARS) system receives traffic flow information for segments of roads with service coverage at a vehicle. A vehicle communications, navigation and tracking (VCNT) service system compares present Global Positioning System (GPS) position of the vehicle with the traffic flow information received from the SDARS system. If the present GPS position is within a segment, the VCNT service system compares present vehicle speed with a received traffic flow speed range. If vehicle speed is outside a received traffic flow speed range, the VCNT service system generates a message with present location and speed. An automated traffic flow aggregation system receives the message transmissions and applies location-specific filters based on number of messages received before forwarding a flow speed revision message to an SDARS broadcast station for broadcasting the traffic information to subscribers. RDS-formatted (e.g., ALERT-C) location codes can be stored at the vehicle and used in the SDARS broadcast of traffic flow information to refer to segments.

15 Claims, 3 Drawing Sheets

OTHER PUBLICATIONS

Brittany Sauser, "Mapping Traffic Flow", Technology Review, May 24, 2007, 2 pages, www.technologyreview.com/printer_friendly_article.aspx?id=18774.

"Car Computers Track Traffic", Wired, Associated Press, Apr. 24, 2005, 2 pages, www.wired.com/print/cars/energy/news/2005/04/67323.

* cited by examiner

SYSTEM AND METHOD FOR IMPROVED TRAFFIC FLOW REPORTING USING SATELLITE DIGITAL AUDIO RADIO SERVICE (SDARS) AND VEHICLE COMMUNICATIONS, NAVIGATION AND TRACKING SYSTEM

This application claims the benefit under 35 U.S.C. §119 (e) of U.S. Provisional Application No. 60/907,494, filed Apr. 4, 2007, in the United States Patent and Trademark Office, the entire disclosure of which is hereby incorporated by reference.

BACKGROUND OF THE INVENTION

1. Field of the Invention

The present invention relates to a system and method for improved traffic flow reporting. More particularly, the present invention relates to a system and method utilizing a Satellite Digital Audio Radio Service (SDARS) system and Vehicle Communications, Navigation, and Tracking (VCNT) services for aggregating traffic flow data and broadcasting traffic flow data to vehicles in a manner that conserves system bandwidth and provides timely traffic flow updates.

2. Description of the Related Art

Traffic information services have been deployed that use sensors and communications technologies to notify commuters of traffic conditions and, in some cases, of alternate routes in an effort to reduce traffic congestion. Typically, these traffic information services receive traffic update data from such sources as private commercial services, police and emergency services, departments of transportation, roadway cameras and airborne reports. However, these updates are usually outdated by the time they are transmitted to commuters.

Some Global Positioning System (GPS) vendors offer traffic reporting options on their GPS devices through FM or satellite-radio add-on devices. These GPS devices with add-on traffic features can receive traffic information for a general area and some can calculate alternate routes to avoid problem traffic areas. Some GPS devices can report information from which current speed and location can be obtained. Some traffic aggregation systems can combine this reported information with other data (e.g., data from departments of transportation, policy and emergency services, private and municipal traffic sensors and cameras and airborne visual reports) to develop historical data or traffic patterns based on date and time for use in tables and maps that can be consulted by commuters. These systems, however, are not updated with sufficient frequency to provide real-time data on the actual traffic flow occurring along a given route or along alternate routes. Thus, the result is often inaccurate drive-time estimates.

Another technology developed to improve traffic information service is the RDS (Radio Data System) standard described in the document TMC Compendium, Alert-C Coding Handbook, Version F02.1, Jan. 2, 1999. According to this standard, information about traffic incidents, including their location, can be broadcast on a radio channel. A RDS-equipped receiver can decode all such traffic information and may filter the information based on receiver location, for example, so that only relevant information is presented to the user.

More specifically, the Traffic Message Channel (TMC) is a specific application of the FM Radio Data System (RDS) used for broadcasting real-time traffic and weather information. Data messages comprising traffic event and location codes are received silently and decoded by a RDS-TMC-equipped car radio or navigation system. RDS-TMC receivers use the same list of event codes and a location database of location codes as the TMC traffic information system (TIS) transmitters. These event and location codes can be provided to a memory device for access by a processor in RDS-TMC receivers by way of a navigation system map on CD-ROM, DVD or other memory device or via downloading (e.g., during manufacture or subsequent to manufacture). Alert-C is the European standard for language-independent exchange of traffic information via the RDS-TMC channel. The selection and standardization of these traffic event and location codes simplifies and reduces bandwidth needed to collect and report changes in traffic flow along roadways characterized by the location codes.

The objective of RDS-TMC is to broadcast Traffic and Travel Information (TTI) messages as data on FM transmissions using RDS. This allows delivery of traffic information to vehicle operators without the need to interrupt playback of their radio program, which is the opposite of the common practice of inserting spoken traffic messages within the broadcast audio content that is received and played back to vehicle occupants. Thus, TTI messages can be inaudible data that is broadcast in the background of existing FM radio programs.

The limited data transmission capacity of the RDS system does not generally permit implementation of RDS-TMC on all program services of the same broadcaster. Therefore, for an RDS-TMC receiver to function correctly as a radio and allow the end user to freely choose the radio program, the RDS-TMC receiver must have a double tuner to permit one tuner to always be used for radio listening and the other tuner be used for RDS-TMC data collection.

Although the RDS-TMC protocol can simplify the reporting of traffic events to vehicles with RDS-equipped receivers, a need remains for improving real-time reporting of traffic events to the TMC traffic information system (TIS) to improve the quality of the traffic event information in the RDS messages sent to the receivers. In other words, a need exists for real-time traffic event data collection.

Vehicle probes are being developed to improve real-time traffic event data collection. Mobile traffic probes generally operate autonomously to collect traffic-related data and report it to a central TIS. Many challenges, however, exist with using vehicle probes such as the complexity of management and costs associated with increased bandwidth use and storage and processing of the voluminous raw data transmitted from these probes to a TIS.

A need therefore exists for an improved traffic data collection and reporting system that provides national or regional coverage and traffic data that is updated with improved frequency for more real-time reporting to commuters of traffic situations.

A need also exists for an improved traffic data collection and reporting system that leverages both the advantages of using compressed traffic event and location data such as RDS-formatted data and the advantages of an SDARS system, which employs a multiplexed digital stream having many channels for supporting reception of traffic flow information without compromising user selection and enjoyment of received audio programming.

In addition, a need exits for an improved traffic data collection and reporting system that improves use of mobile vehicle probes.

SUMMARY OF THE INVENTION

Exemplary embodiments of the present invention address at least the above problems and/or disadvantages and provide at least the advantages described herein.

Accordingly, exemplary embodiments of the present invention provide a system and method utilizing a Satellite Digital Audio Radio Service (SDARS) system and a Vehicle Communications, Navigation and Tracking (VCNT) service system for aggregating traffic flow data and broadcasting the data to vehicles.

An aspect of exemplary embodiments of the present invention is a traffic flow reporting system comprising a SDARS system for transmitting traffic flow information segments of roads with service coverage to a vehicle; and a VCNT service system for comparing a present Global Positioning System (GPS) position of the vehicle with the traffic flow information on segments received from the SDARS system.

An aspect of exemplary embodiments of the present invention provides that, if the present GPS position is within a segment, the VCNT service system of the vehicle compares a present vehicle speed with a received traffic flow speed range.

An aspect of exemplary embodiments of the present invention further provides that, if a vehicle speed is outside a received traffic flow speed range, the VCNT service system generates a message with a present location and speed.

Another aspect of exemplary embodiments provides an automated traffic flow aggregation system for receiving message transmissions from vehicle probes with VCNT service system and SDARS system and applying location-specific filters based on a number of messages received before forwarding a flow speed revision message to the SDARS system.

An aspect of exemplary embodiments of the present invention provides that the SDARS transmits revised traffic flow information for the segment and broadcasts traffic information to the subscribers at their location.

According to another aspect of exemplary embodiments of the present invention, when the comparison of vehicle speed to received traffic flow speed range by the VCNT service system indicates a downgrade in speed, a SMS message is transmitted immediately when encountered within a traffic segment.

According to another aspect of exemplary embodiments of the present invention, when the comparison of vehicle speed to received traffic flow speed range by the VCNT service system indicates a vehicle speed upgrade, the SMS message is transmitted once the complete segment has been traversed.

In addition, according to another aspect of exemplary embodiments of the present invention, frequency of vehicle messaging to report traffic flow is controlled based on vehicle speed within a selected speed range. Revisions to flow speeds reported back to vehicles is controlled based on the number of messages received for a selected location, and further vehicle messages are suspended until flow speed changes for that location. Thus, system bandwidth resources are managed, which is an important advantage since signaling congestion can become an issue for other traffic flow aggregation systems that may adopt more real-time data collection and reporting in the future.

Other aspects, advantages, and salient features of the invention will become apparent to those skilled in the art from the following detailed description, which, taken in conjunction with the annexed drawings, discloses exemplary embodiments of the invention.

BRIEF DESCRIPTION OF THE DRAWINGS

The above and other aspects, features, and advantages of certain embodiments of the present invention will be more apparent from the following description taken in conjunction with the accompanying drawings, in which.

Throughout the drawings, the same drawing reference numerals will be understood to refer to the same elements, features, and structures.

DETAILED DESCRIPTION OF EXEMPLARY EMBODIMENTS

The matters defined in the description such as a detailed construction and elements are provided to assist in a comprehensive understanding of the embodiments of the invention and are merely exemplary. Accordingly, those of ordinary skill in the art will recognize that various changes and modifications of the embodiments described herein can be made without departing from the scope and spirit of the invention. Also, descriptions of well-known functions and constructions are omitted for clarity and conciseness.

Contemporary vehicles may be provided with various types of equipment that allow for communication/interaction with various services and systems that may be controlled by the commuters who subscribe to these services. Examples of some services available to commuters include Satellite Digital Audio Radio Service (SDARS) systems that provide radio programming to listeners and Vehicle Communications, Navigation and Tracking (VCNT) services that provide various features such as telecommunications, remote vehicle function monitoring/controlling, vehicle position tracking and navigation. XM Satellite Radio and Sirius are examples of SDARS systems. OnStar Corporation's telematics service provided in General Motors vehicles is an example of one VCNT service that provides detection of collisions or other vehicle malfunctions and two-way telecommunications with a human responder, as well as vehicle position determination and navigation. Other VCNT services can provide solely vehicle position determination and navigation services and only one-way communications service for receiving traffic event information for use by a navigation system.

Figure 1:
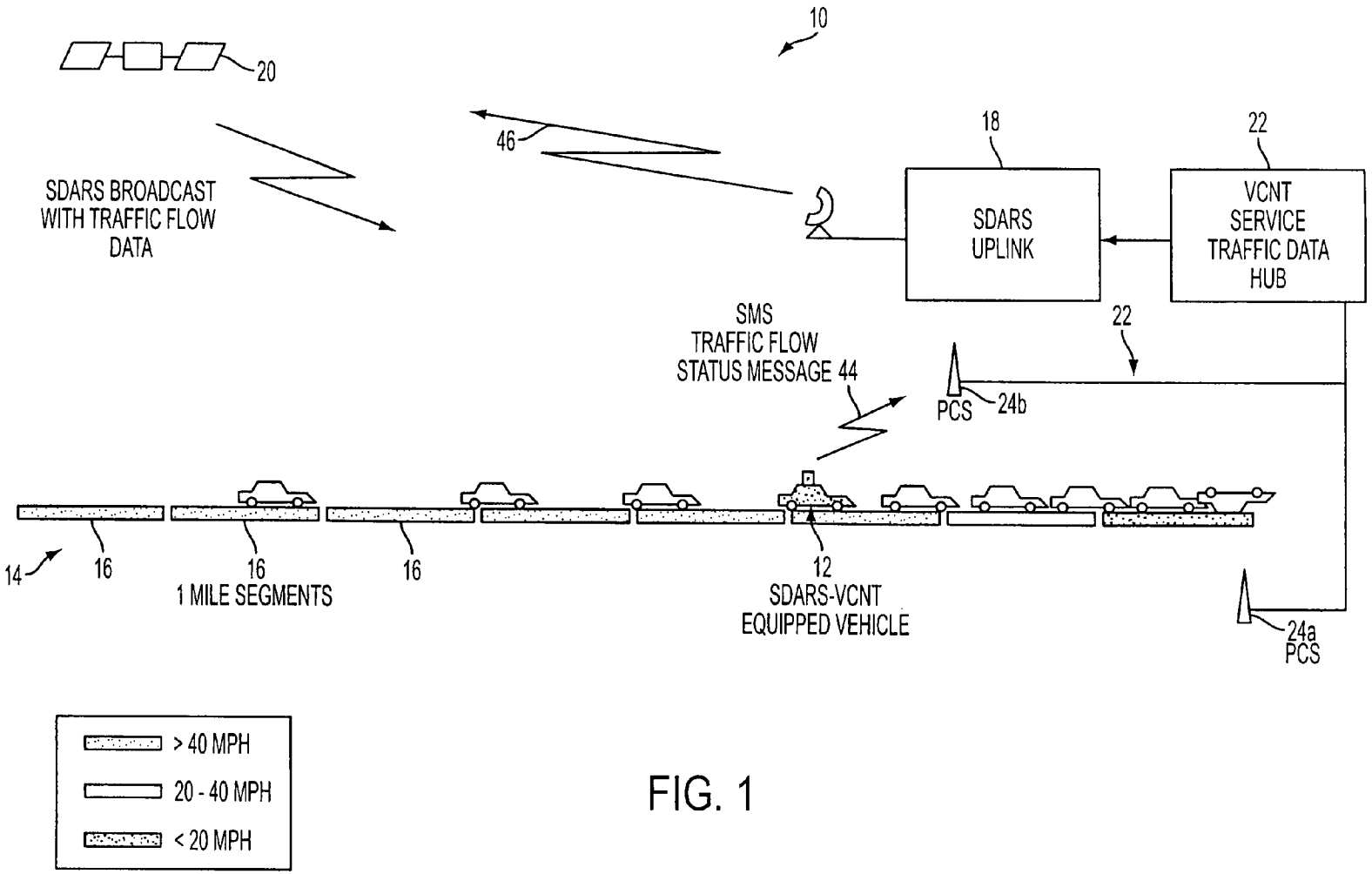
FIG. 1 is a diagram illustrating a traffic flow system according to an exemplary embodiment of the present invention.

In accordance with an exemplary embodiment of the present invention, a traffic flow reporting system 10 is depicted in FIG. 1 that employs vehicles 12 (depicted in FIG. 2) which are equipped with one or more devices for delivering both SDARS and VCNT service to the vehicle occupant(s) to provide improved traffic monitoring and reporting. As described in further detail below, the vehicle device(s) for delivering both SDARS and VCNT service are configured to selectively generate messages 44 (e.g., SMS messages over a PCS network) to a VCNT service hub 22 that filters the received messages 44 and, in turn, sends updated traffic status information to an SDARS broadcast system 18 for broadcasting aggregated traffic flow data to SDARS subscriber vehicles 12. System bandwidth is managed by controlling when the vehicle messages 44 are sent to the VCNT service hub 22. Traffic update frequency and accuracy are optimized by filtering the messages at the hub 22 before sending updates to the broadcast system 18 for transmission of traffic reports to vehicle operators.

Figure 2:
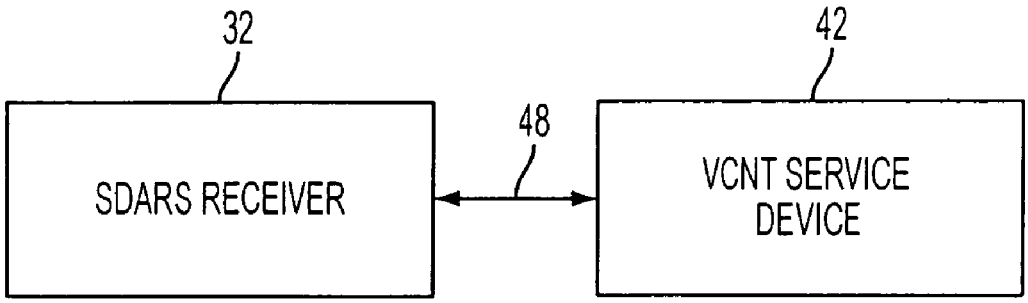
FIG. 2 is a diagram illustrating SDARS and VCNT service components in a vehicle according to an exemplary embodiment of the present invention.

With reference to FIGS. 1 and 2, a vehicle 12 constructed in accordance with an exemplary embodiment of the present invention is provided with equipment for use with both a SDARS system and a VCNT service system. The vehicle 12 can be provided with a SDARS receiver 32 that is operable to receive and playback a SDARS broadcast signal 46. The SDARS broadcast signal 46 is broadcast via a satellite 20 and/or terrestrial transmitter (not shown), and is provided to the satellite and/or terrestrial transmitter via an uplink from an SDARS broadcast station 18. Illustrative examples of SDARS systems, devices and signal formats are disclosed in co-owned U.S. Pat. Nos. 7,263,329, 7,180,917, 7,075,946, 6,834,156, 6,823,169, 6,785,656, 6,564,003, 6,493,546, 6,272,328 and U.S. Patent Application Publication No. 20060126716, which are incorporated herein by reference.

With continued reference to FIGS. 1 and 2, the vehicle 12 further comprises a VCNT service device 42 that comprises a GPS device or interfaces with a separate GPS device to determine the location of the vehicle, as well as its speed.

The VCNT service device 42 has an interface 48 to the SDARS receiver 32 for receiving traffic flow information that has been demultiplexed from a received SDARS broadcast signal 46.

With further reference to FIG. 2, the VCNT service device 42 comprises a controller and memory and is programmed to process and store data from the traffic flow information that was received via the interface 48. The VCNT service device 42 has a GPS device or at least input for receiving GPS data from a separate GPS device. The memory preferably comprises data such as a traffic data table comprising location codes and corresponding position data characterizing segments of roadways covered by the system 10. The memory can also store current vehicle speed and position data, as well as data relating to speeds experienced by vehicles along the current segment being traveled on by the vehicle as reported in traffic flow information received from SDARS receiver 32. By way of an illustrative example, the traffic data table can comprise Alert C formatted location codes and corresponding GPS data. The VCNT service device 42 further comprises a display for navigation maps, and a user input device.

It is to be understood that the vehicle SDARS receiver and VMCT service device or components depicted in FIG. 2 can be integrated, separate from each other, or have some common components. Further, it is to be understood that the VMCT service system can comprise other components than those depicted in FIG. 1, that is, the two PCS transmitters and traffic data hub 22. For example, the VMCT call center that connects human operators to VMCT-equipped vehicle occupants can be separate from the traffic data hub 22 shown in FIG. 1.

In accordance with an exemplary embodiment of the present invention, the SDARS broadcast station 18 transmits a broadcast signal 46 comprising digital radio programming and ancillary data which can comprise traffic flow information relating to roadways 14 monitored by the system 10. The traffic flow information can comprise information relating to different segments 16 or groups of segments constituting each of the roadways 14 covered by the system 10. As shown in FIG. 1, the roadways 14 are preferably divided into segments 16 of a selected length (e.g., 1 mile segments) that are uniquely identified by location codes, for example. The traffic flow information can indicate for each of a number of segments 16 the currently reported speed of vehicles 12 traveling on those segments 16 or a range of speeds.

As stated above, the traffic flow information in the received SDARS broadcast system 46 can be demodulated and demultiplexed from the received signals by the SDARS receiver 32 and provided to the VCNT service device 42, which compares segment identifiers in the received traffic data with those identifiers of segments 16 on which the vehicle 12 is sensing and reporting fair to poor traffic conditions.

In accordance with an aspect of an exemplary embodiment of the present invention, selected speed ranges are designated for respective segments 16 to represent different traffic flow conditions on traffic flow monitored roadways 14 in the system 10. For example, in the illustrated exemplary embodiment shown in FIG. 1, the speed ranges for the segments 16 constituting the roadway 14 are, respectively, (1) speeds above 40 miles per hour (>40 mph) representing good traffic flow conditions for that particular roadway 14; (2) speeds between 20 and 40 mph (20-40 mph) for fair traffic flow conditions (e.g., traffic flow beginning to slow down due to congestion); and (3) speeds below 20 miles per hour (<20 mph) representing poor traffic flow conditions for that particular roadway 14.

As exemplified in FIGS. 1 and 2, the VCNT module 38 is operated in accordance with an embodiment of the present invention to transmit a message 44 (e.g., a short message service (SMS) message) to the hub 22 when it determines that the current vehicle speed is in the fair or poor range designated for the segment 16 in which the vehicle 12 is traveling. The message 44 can comprise current vehicle speed and segment identifier (e.g., a location code), among other information. Alternatively, the identifier for the segment 16 that the vehicle 12 is traversing at the time of messaging can already have been communicated to the hub 22 or determined at the hub 22 by a separate process apart from traffic flow messaging from the vehicle. The hub 22 is programmed to aggregate and filter such messages from vehicles 12 experiencing traffic flow conditions below good speed ranges for the corresponding segments 16. For example, the hub 22 can be required to receive a selected number of messages relating to a group of segments 16 corresponding to a roadway 14 experiencing delays before sending a message to the SDARS broadcast station 18.

The SDARS broadcast station 18 modifies the SDARS broadcast signal to update the traffic report for that particular roadway 14. It is to be understood that traffic flow information can be included in an SDARS broadcast signal a number of different ways. For example, the SDARS broadcast can include traffic flow information as ancillary data transmitted with the digital radio programming (e.g., a group of bits in the broadcast signal stream that identifies a roadway 14 or one or more segments 16 and conditions such as current reported speed using location and traffic event codes). The traffic flow information can contain designated bits for traffic flow conditions pertaining to each roadway or group of segments, thereby providing continuous information relating to traffic flow conditions whether they are good, fair, or poor. Alternatively, the traffic flow information can be bits for only those segments 16 or roadways 14 experiencing fair or poor conditions, in which case the VCNT modules 38 in vehicles 12 would report good conditions unless these bits were received.

It is to be understood that the segments 16 can have varying lengths depending on the degree of traffic congestion generally associated with that particular geographic area. The attributes of segments and associated speeds can be changed within the software used to implement the system 10 as needed. The number of speed ranges used to report traffic flow conditions on roadways 14 can be one or more ranges. For example, traffic flow conditions may be determined as good or poor depending on whether vehicle speed 12 on a segment 16 is simply above or below a selected speed. Alternatively, traffic conditions for a roadway 14 (e.g., such as a metropolitan beltway) can be reported on the basis of vehicle speed 12 on a segment 16 being in one of plural selected ranges.

In addition, the conditions for controlling a VCNT service device 42 to send a message 44 to the hub 22 can vary based on a number of criteria. For example, the VCNT service device 42 can be controlled to send a message to the hub 22 only when determined vehicle speed is in one or more speed ranges selected for that segment 16 and not other ones of its speed ranges, as well as to send messages to the hub 22 at different frequencies depending on the determined speed range for the vehicle or another criterion. Further, the VCNT service device 42 can be controlled to refrain from sending messages 44 to the hub 22 to reduce signaling congestion and unnecessary use of bandwidth. For example, the VCNT service device 42 can be controlled to refrain from sending messages 44 once it has received an SDARS broadcast signal comprising updated traffic flow information for the segment 16 for which the VCNT module 38 had been sending messages. The traffic flow information in the received SDARS broadcast system 46 can be demodulated and demultiplexed from the received signals by the SDARS head unit 32 and provided to the VCNT service device 42, which compares segment identifiers or location codes in the received traffic data with the location code of the segment 16 on which the vehicle 12 is traveling, as well as sensing and reporting fair to poor traffic conditions. The hub 22 can instruct the SDARS broadcast station 18 to include in the SDARS broadcast signal 46 commands for selected vehicles 12 or groups of vehicles 12 (e.g., meet one or more selected criteria) to respond with a message (e.g., respond at a selected time).

An exemplary embodiment of the present invention will now be described with reference to FIG. 3.

Figure 3:
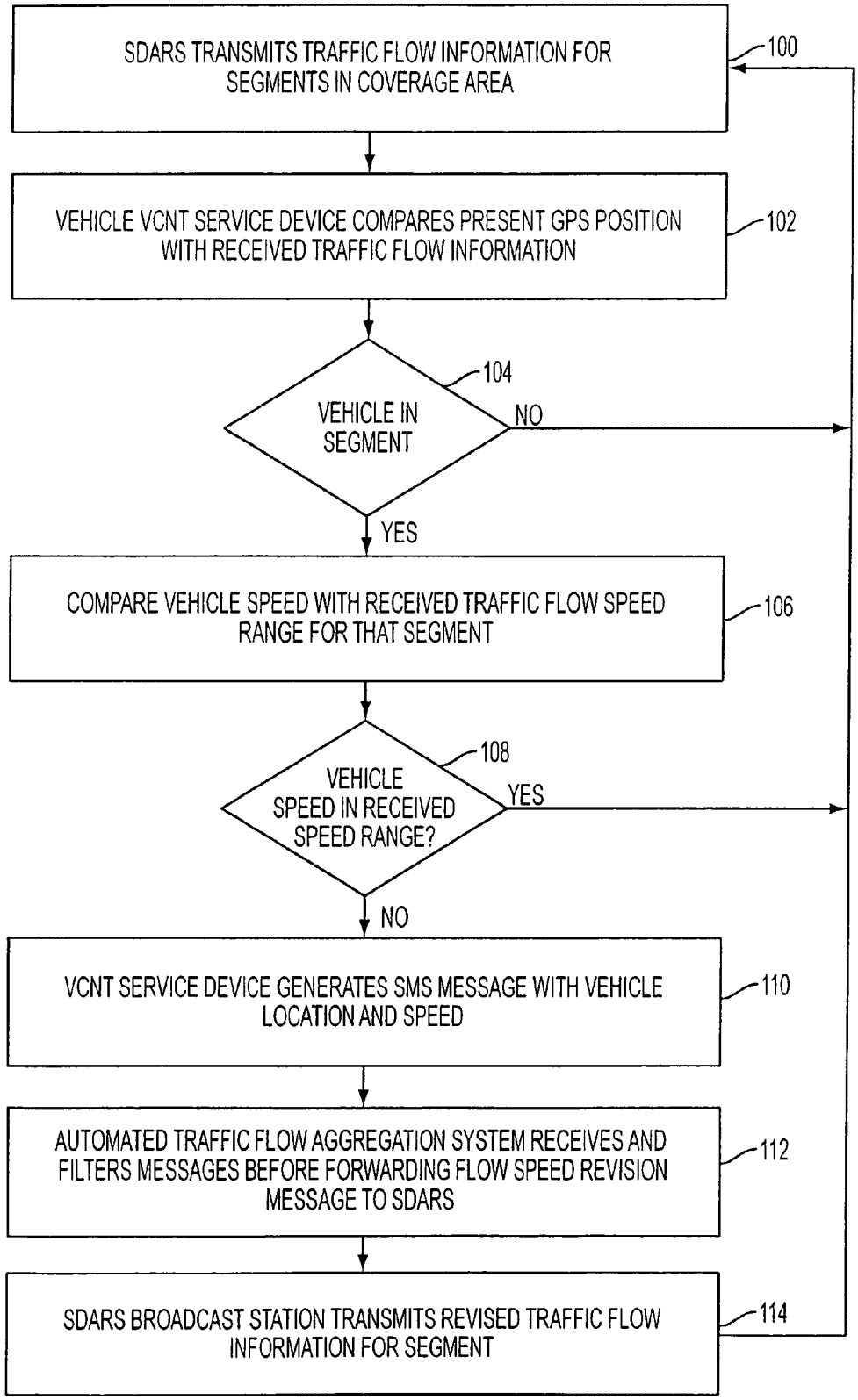
FIG. 3 is a flow chart illustrating a traffic flow system according to an exemplary embodiment of the present invention.

Referring to FIG. 3, a traffic flow system 10 comprises an SDARS system for transmitting, in addition to audio programming, traffic flow information relating to segments 14 of roads 16 with service coverage to a vehicle 12 (S100).

A vehicle VCNT system then compares a present Global Positioning System (GPS) position of the vehicle 12 with the traffic flow information for segments received from the SDARS system (S102).

If the present GPS position is within a segment 14 (e.g., as determined from a stored data table at the vehicle comprising RDS-formatted location codes and corresponding GPS data) (S104), the VCNT service device 42 of the vehicle 12 compares a present vehicle speed with a received traffic flow speed range for that segment 14 (S106).

If a vehicle speed is outside a received traffic flow speed range for that segment (S108), the VCNT service device 42 generates an SMS message with a present location and speed (S110).

An automated traffic flow aggregation system 22 receives SMS transmissions and applies location-specific filters based on a number of messages received, before forwarding a flow speed revision message to the SDARS system (S112).

The SDARS broadcast station 18 then transmits revised traffic flow information for the segment and broadcasts traffic information to the subscribers at their locations (S114).

In accordance with an exemplary embodiment of the present invention, when the comparison of current vehicle speed to received traffic flow speed range in S106 indicates a downgrade in speed within a traffic segment, an SMS message is preferably transmitted immediately to the hub 22. When the comparison of current vehicle speed to received traffic flow speed range by the VCNT service device 42, however, indicates a vehicle speed upgrade, the SMS message is transmitted once the complete segment 14 has been traversed.

The traffic flow reporting system 10 exemplified herein can provide more accurate and reliable traffic flow reporting than known traffic data aggregation technology. Another advantage is that the cost to add traffic coverage to new or expanded markets for a SDARS service provider having a telematics or navigation system partner is merely the addition of SMS message traffic. Traffic collection and reporting will also improve over time as addition vehicle probes 12 are added to the system 10.

The present invention can also be embodied as computer-readable codes on a computer-readable recording medium. The computer-readable recording medium is any data storage device that can store data which can thereafter be read by a computer system. Examples of the computer-readable recording medium include, but are not limited to, read-only memory (ROM), random-access memory (RAM), CD-ROMs, magnetic tapes, floppy disks, optical data storage devices, and carrier waves (such as data transmission through the Internet via wired or wireless transmission paths). The computer-readable recording medium can also be distributed over network-coupled computer systems so that the computer-readable code is stored and executed in a distributed fashion. Also, functional programs, codes, and code segments for accomplishing the present invention can be easily construed as within the scope of the invention by programmers skilled in the art to which the present invention pertains.

While certain exemplary embodiments of the invention have been shown and described herein with reference to certain preferred embodiments thereof, it will be understood by those skilled in the art that various changes in form and details may be made therein without departing from the spirit and scope of the invention as defined by the appended claims and their equivalents.

What is claimed is:

1. A method of providing traffic flow information comprising:

storing, at a vehicle, at least one data table comprising location data that corresponds to different segments of roadways over which traffic flow is monitored;

receiving, at a vehicle, a digital audio broadcast (DAB) signal comprising multiplexed audio programming channels and at least one data channel for providing traffic flow information, the traffic flow information comprising traffic data relating to a reported speed range for vehicles traveling on respective ones of the segments of roadways;

determining, at the vehicle, its current position data;

determining, at the vehicle, if its current position data is within one of the segments by comparing its current position data with the location data in the data table;

determining, at the vehicle, its current vehicle speed;

if the vehicle is determined to be traveling within one of the segments, then determining if its current vehicle speed is within the reported speed range for that segment;

generating, at the vehicle, a message reporting its current vehicle speed for transmission to a traffic flow information hub when its current vehicle speed is not within the reported speed range for that segment; and controlling the vehicle to not send a message reporting its current vehicle speed when its current vehicle speed is within the reported speed range for that segment.

2. A method as claimed in claim 1, further comprising transmitting the message immediately from the vehicle as a speed downgrade message when its current vehicle speed is below the reported speed range for that segment.

3. A method as claimed in claim 1, further comprising:

determining when current vehicle speed is above the reported speed range for that segment;

determining when the vehicle has completed traversing that segment by comparing updates of its current position data with the location data corresponding to that segment in the data table; and delaying generating and transmitting a speed upgrade message that indicates the current vehicle speed is above the reported speed range for that segment until the vehicle has completed traversing that segment.

4. A method as claimed in claim 1, further comprising:

continuing receiving, at the vehicle, the digital audio broadcast (DAB) signal wherein the data channel provides revised traffic flow information with respect to previously received traffic flow information;

determining, at the vehicle, that a reported speed range for that segment in the revised traffic flow information is unchanged; and delaying generation and transmission of a message until the reported flow speed for that segment changes.

5. A method as claimed in claim 1, further comprising employing location codes for the location data in the data table and for the traffic flow information in the DAB broadcast signal.

6. A method as claimed in claim 5, further comprising employing RDS-formatted location codes for the location data in the data table and for the traffic flow information in the DAB broadcast signal.

7. A method as claimed in claim 5, further comprising employing RDS-formatted location codes to characterize the segments in the data table.

8. A method as claimed in claim 1, further comprising updating the traffic flow information in the DAB signal based on messages reporting current vehicle speed received at the traffic flow information hub from corresponding ones of a plurality of vehicles.

9. A method as claimed in claim 8, further comprising filtering the messages received at the traffic flow information hub from the plurality of vehicles to determine when to update the traffic flow information in the DAB signal.

10. A method as claimed in claim 9, wherein filtering comprises updating the traffic flow information in the DAB signal when a number of the messages received at the traffic flow information hub and related to one of the segments of roadway exceeds a selected threshold.

11. A traffic flow reporting system, comprising:

a satellite digital audio radio service (SDARS) system for transmitting a digital audio broadcast (DAB) signal comprising multiplexed audio programming channels and at least one data channel for providing traffic flow information, the traffic flow information comprising traffic data relating to a reported speed range for vehicles traveling on respective ones of the segments of roadways;

a plurality of vehicles, each of the plurality of vehicles comprising an SDARS receiving unit, and a vehicle communications, navigation and tracking (VCNT) services unit configured to store a data structure comprising location data that corresponds to different segments of roadways over which traffic flow is monitored compare a present Global Positioning System (GPS) position of the vehicle with the traffic flow information received from the SDARS unit, if the present GPS position is within one of the segments, compare a current vehicle speed with a corresponding received traffic flow speed range reported in the traffic flow information, and if the vehicle speed is outside the received traffic flow speed range, generate a message with one of the location data for the segment and the present GPS position of the vehicle and current vehicle speed; and an automated traffic flow aggregation system for receiving transmissions of messages from the plurality of vehicles and applying location-specific filters based on a number of messages received before forwarding a flow speed revision message to the SDARS system.

12. A traffic flow reporting system as claimed in claim 11, wherein the SDARS system broadcasts a DAB signal comprising revised traffic flow information for the segment.

13. A traffic flow reporting system as claimed in claim 11, wherein, when the comparison of vehicle speed to received traffic flow speed range by the VCNT services unit indicates a downgrade in speed, the message is transmitted immediately when encountered within the segment.

14. A traffic flow reporting system as claimed in claim 11, wherein, when the comparison of vehicle speed to received traffic flow speed range by the VCNT system indicates a vehicle speed upgrade, the message is transmitted once the complete segment has been traversed.

15. A traffic flow reporting system as claimed in claim 11, wherein the VCNT system is controlled to not send a message reporting its current vehicle speed when its current vehicle speed is within the reported speed range for that segment.

* * * * *